US008556605B2

(12) United States Patent
Hirata

(10) Patent No.: US 8,556,605 B2
(45) Date of Patent: Oct. 15, 2013

(54) SCROLL COMPRESSOR HAVING A ROTATION INHIBITOR

(75) Inventor: Hirofumi Hirata, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 201 days.

(21) Appl. No.: 13/063,030

(22) PCT Filed: Mar. 26, 2010

(86) PCT No.: PCT/JP2010/055363

§ 371 (c)(1),
(2), (4) Date: Mar. 9, 2011

(87) PCT Pub. No.: WO2010/113794

PCT Pub. Date: Oct. 7, 2010

(65) Prior Publication Data

US 2011/0165006 A1 Jul. 7, 2011

(30) Foreign Application Priority Data

Mar. 31, 2009 (JP) ..... 2009-087516

(51) Int. Cl.
*F03C 2/00* (2006.01)
*F03C 4/00* (2006.01)
*F04C 18/00* (2006.01)

(52) U.S. Cl.
USPC ..... 418/55.3; 418/55.1; 418/181

(58) Field of Classification Search
USPC ..... 418/55.1–55.6, 57, 181, 100, 151
See application file for complete search history.

(56) References Cited

U.S. PATENT DOCUMENTS 5,201,646 A * 4/1993 Dees et al. ..... 418/55.5
5,575,635 A * 11/1996 Yamamoto et al. ..... 418/55.5
5,681,155 A * 10/1997 Hisanaga et al. ..... 418/55.5

FOREIGN PATENT DOCUMENTS

JP 62-103659 U 7/1987
JP 62-194907 U 12/1987
JP 8-093666 A 4/1996
JP 9-105390 A 4/1997
JP 9-170575 A 6/1997
JP 2003-341531 A 12/2003
JP 2007-332919 A 12/2007

OTHER PUBLICATIONS

International Search Report of PCT/JP2010/055363, date of mailing Jun. 29, 2010.
"Retaining Rings (E Type)" Korean Industrial Standard KS B 1337 dated Jul. 23, 1990, Korean Office Action dated Jul. 24, 2013. (3 pages).
Office Action dated Jul. 24, 2013, issued in corresponding to Korean Application No. 10-2011-7006440. "English translation only".

* cited by examiner

*Primary Examiner* — Theresa Trieu
(74) *Attorney, Agent, or Firm* — Westerman, Hattori, Daniels & Adrian, LLP

(57) ABSTRACT

An object is to provide a scroll compressor capable of avoiding problems caused by abnormal wear of a retaining ring used to prevent a cylindrical ring from being detached. The scroll compressor includes a crank shaft having a crank pin (6C) at a shaft end, a drive bush (10) into which the crank pin (6C) is fitted, a cylindrical ring (11) that is rotatably fitted to an outer periphery of the drive bush (10) and whose axial movement is inhibited by a retaining ring (27) mounted on the tip of the crank pin (6C), a drive bearing that is fitted to an outer periphery of the cylindrical ring (11). An orbiting scroll fitted to an outer periphery of the drive bearing is driven in an orbiting manner through the rotation of the crank shaft. A rotation inhibitor that interferes with the retaining ring (27) to inhibit the rotation of the retaining ring (27) is provided on an end surface of the drive bush (10).

5 Claims, 4 Drawing Sheets

SCROLL COMPRESSOR HAVING A ROTATION INHIBITOR

TECHNICAL FIELD

The present invention relates to an improved drive mechanism for driving an orbiting scroll of a scroll compressor in an orbiting manner.

BACKGROUND ART

In a scroll compressor, an orbiting scroll that constitutes a compression mechanism together with a fixed scroll is generally configured such that the orbiting scroll fitted to the outer periphery of a drive bearing is driven so as to orbit around the fixed scroll, via a driving mechanism that includes a crank shaft having a crank pin at a shaft end, a drive bush fitted to the crank pin, and the drive bearing fitted to the outer periphery of the drive bush.

In this scroll compressor, there is a problem in that, because gas pressure imposed on the orbiting scroll during operation is always imposed at a fixed position of the drive bush, concentrated surface fatigue occurs at one position of the drive bush, thus shortening the lifetime of the drive bush. PTLs 1 to 3 describe technologies in which a cylindrical ring (floating bush) is rotatably fitted to the outer periphery of the drive bush in order to avoid this concentrated surface fatigue occurring on the surface of the drive bush to extend the lifetime of the drive bush.

In the above-described cylindrical ring (floating bush), one end thereof is brought into contact with a step portion of the drive bush to prevent detachment, and the other end (shaft end) thereof is prevented from being axially detached by a retaining plate fixed at the tip of the crank pin via a snap ring or by a retaining ring mounted in a tip groove of the crank pin so as to be partially engaged with the cylindrical ring (see PTLs 1 to 3).

CITATION LIST

Patent Literature

{PTL 1} Japanese Unexamined Patent Application, Publication No. Hei-8-93666 (See FIG. 1)

{PTL 2} Japanese Unexamined Patent Application, Publication No. Hei-9-105390 (See FIG. 1)

{PTL 3} Japanese Unexamined Patent Application, Publication No. 2007-332919 (See FIG. 1)

SUMMARY OF INVENTION

Technical Problem

However, as a cylindrical-ring (floating-bush) retaining structure, the structure having the retaining plate fixed to the crank pin via the snap ring can reliably prevent the cylindrical ring from being axially detached but needs to be provided with the dedicated retaining plate in addition to the snap ring. Therefore, additional parts specially designed for retaining are required, leading to unavoidable problems of an increase in the number of parts, an increase in man-hours for manufacture and assembly, and an increase in cost.

In the structure having the retaining ring provided at the tip of the crank pin so as to be partially engaged with the cylindrical ring, when the retaining ring is rotated in accordance with the rotation and vibration of the cylindrical ring and the drive bush due to the intermittent operation or the continuous operation of the compressor, and an opening portion provided for the retaining ring is moved to a position where the retaining ring is partially engaged with the cylindrical ring, an engagement allowance (area) of the retaining ring with respect to the cylindrical ring is reduced. As a result, the surface pressure of the retaining ring is increased, and abnormal wear occurs, thus causing problems, such as deterioration in function.

The present invention has been made in view of these circumstances, and an object thereof is to provide a scroll compressor capable of avoiding problems caused by abnormal wear of the retaining ring used to prevent the detachment of the cylindrical ring.

Solution to Problem

In order to solve the above-described problems, the scroll compressor of the present invention employs the following solutions.

Specifically, according to one aspect of the present invention, there is provided a scroll compressor including: a crank shaft that has a crank pin at a shaft end; a drive bush into which the crank pin is fitted; a cylindrical ring that is rotatably fitted to an outer periphery of the drive bush and whose axial movement is inhibited by a retaining ring mounted on the tip of the crank pin; and a drive bearing that is fitted to an outer periphery of the cylindrical ring, an orbiting scroll fitted to an outer periphery of the drive bearing being driven in an orbiting manner through rotation of the crank shaft, in which a rotation inhibitor that interferes with the retaining ring to inhibit rotation of the retaining ring is provided on an end surface of the drive bush.

According to the above-described aspect, because the rotation inhibitor that interferes with the retaining ring to inhibit the rotation of the retaining ring is provided on the end surface of the drive bush, it is possible to prevent the retaining ring, which inhibits the axial movement of the cylindrical ring fitted to the outer periphery of the drive bush, from rotating about the crank pin with the rotation inhibitor provided on the end surface of the drive bush and to hold the retaining ring at an appropriate position to avoid a reduction in the engagement allowance (area) of the retaining ring with respect to the cylindrical ring, which occurs when the opening portion of the retaining ring is moved to a position where the retaining ring is engaged with the cylindrical ring. Therefore, it is possible to prevent abnormal wear generated by an increase in surface pressure of the retaining ring caused by a reduction in the engagement allowance with respect to the cylindrical ring and to avoid problems due to deterioration in function.

In the above-described scroll compressor, the rotation inhibitor may be formed of a protrusion that protrudes axially outward from the end surface of the drive bush.

According to the above-described aspect, because the rotation inhibitor is formed of a protrusion that protrudes axially outward from the end surface of the drive bush, it is possible to reliably prevent the rotation of the retaining ring through interference with the protrusion and to prevent a reduction in the engagement allowance (area) of the retaining ring with respect to the cylindrical ring. Therefore, it is possible to prevent abnormal wear of the retaining ring and to avoid problems due to deterioration in function.

In one of the above-described scroll compressors, the rotation inhibitor may be provided at a position where it interferes with an opening portion provided for the retaining ring, in an initial mounting state where the retaining ring is set to have a predetermined engagement allowance with respect to the cylindrical ring.

According to the above-described aspect, because the rotation inhibitor is provided at a position where it interferes with the opening portion provided for the retaining ring, in the initial mounting state where the retaining ring is set to have the predetermined engagement allowance with respect to the cylindrical ring, even if the retaining ring attempts to rotate leftward or rightward from the initial mounting position in accordance with the rotation and vibration of the cylindrical ring and the drive bush, the rotation of the retaining ring is prevented through interference with the rotation inhibitor provided at the position where it interferes with the opening portion. Therefore, it is possible to maintain the predetermined engagement allowance (area) of the retaining ring with respect to the cylindrical ring and to prevent abnormal wear caused by a reduction in the engagement allowance, thus avoiding problems due to deterioration in function.

In one of the above-described scroll compressors, a pair of the rotation inhibitors may be provided at positions where they interfere with outer peripheries of a pair of engaging portions provided for the retaining ring, in an initial mounting state where the retaining ring is set to have a predetermined engagement allowance with respect to the cylindrical ring.

According to the above-described aspect, because a pair of the rotation inhibitors are provided at positions where they interfere with the outer peripheries of the pair of engaging portions provided for the retaining ring, in the initial mounting state where the retaining ring is set to have the predetermined engagement allowance with respect to the cylindrical ring, even if the retaining ring attempts to rotate leftward or rightward from the initial mounting position in accordance with the rotation and vibration of the cylindrical ring and the drive bush, the rotation of the retaining ring is prevented through interference with the pair of rotation inhibitors, provided at positions where they interfere with the outer peripheries of the engaging portions. Therefore, it is possible to maintain the predetermined engagement allowance (area) of the retaining ring with respect to the cylindrical ring and to prevent abnormal wear caused by a reduction in the engagement allowance, thus avoiding problems due to deterioration in function.

In one of the above-described scroll compressors, the rotation inhibitor may be formed of an outward protrusion left at the center of the end surface of the drive bush when the end surface is cut.

According to the above-described aspect, the rotation inhibitor is formed of the outward protrusion left at the center of the end surface of the drive bush when the end surface is cut; therefore, by leaving the center of the end surface of the drive bush when the end surface of the drive bush is cut, the protrusion serving as the rotation inhibitor can be formed at the same time as the end surface of the drive bush is cut. Therefore, it is possible to provide the rotation inhibitor without increasing processing man-hours or using an additional part, to prevent abnormal wear of the retaining ring without unnecessary cost or man-hours, and to avoid problems due to deterioration in function.

Advantageous Effects of Invention

According to the present invention, it is possible to prevent the retaining ring, which inhibits the axial movement of the cylindrical ring fitted to the outer periphery of the drive bush, from rotating about the crank pin with the rotation inhibitor provided on the end surface of the drive bush and to hold the retaining ring at an appropriate position to prevent a reduction in the engagement allowance (area) of the retaining ring with respect to the cylindrical ring, which occurs when the opening portion of the retaining ring is moved to a position where the retaining ring is engaged with the cylindrical ring. Thus, it is possible to prevent abnormal wear generated by an increase in surface pressure of the retaining ring caused by a reduction in the engagement allowance with respect to the cylindrical ring and to avoid problems due to deterioration in function.

DESCRIPTION OF EMBODIMENTS

Embodiments of the present invention will be described below with reference to the drawings.

First Embodiment

A first embodiment of the present invention will be described below using FIGS. 1 and 2.

Figure 1:
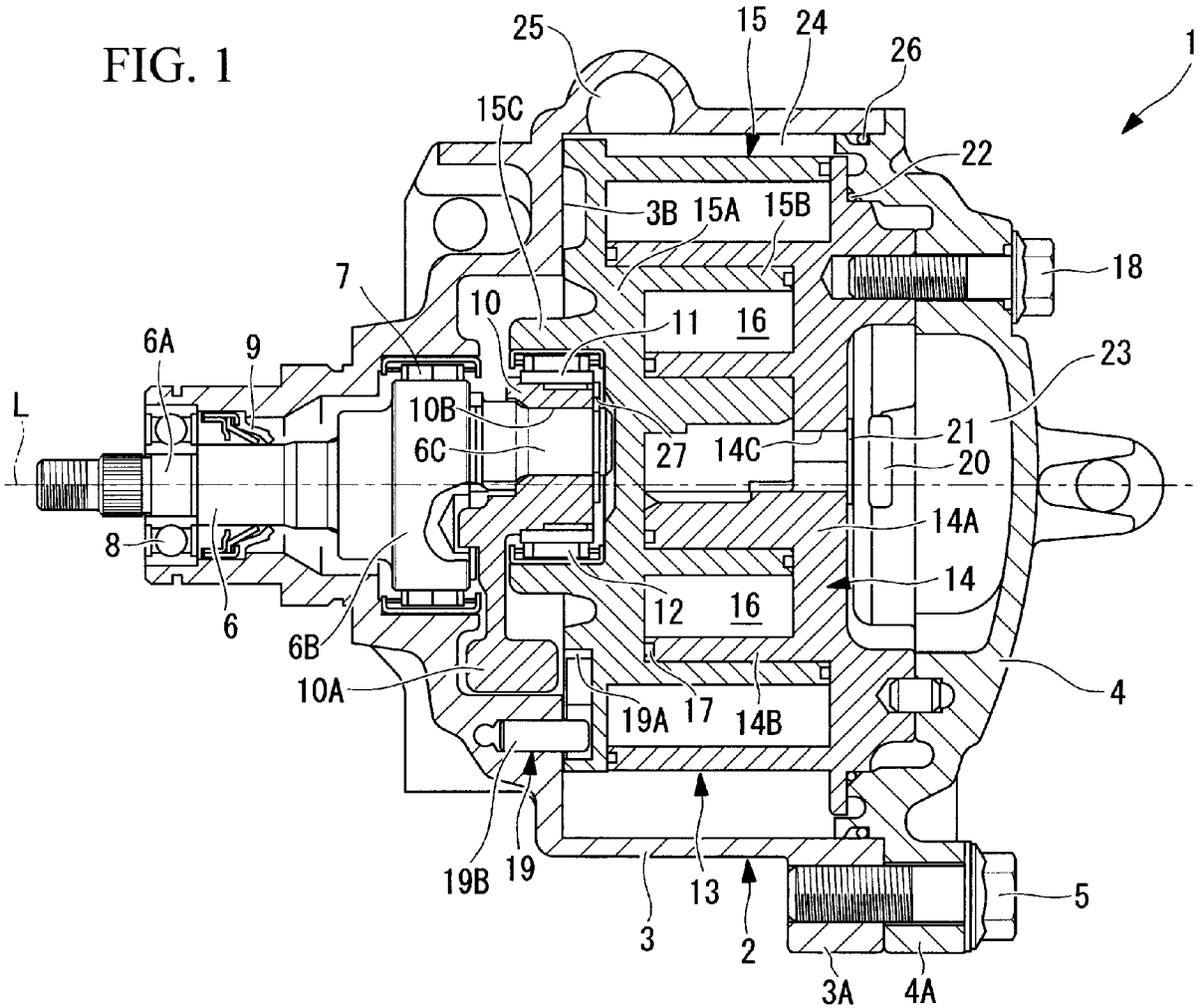
FIG. 1 is a longitudinal sectional view of a scroll compressor according to a first embodiment of the present invention.

FIG. 1 is a longitudinal sectional view showing a scroll compressor according to the first embodiment of the present invention. A scroll compressor 1 has a housing 2 that forms an outer envelope. The housing 2 is structured by tightening a front housing 3 and a rear housing 4 together with bolts 5. Flanges 3A and 4A for tightening are integrally formed at a plurality of positions, for example, four positions, on the circumferences of the front housing 3 and the rear housing 4 at regular intervals, respectively. When the flanges 3A and 4A are tightened with the bolts 5, the front housing 3 and the rear housing 4 are integrally combined.

In the front housing 3, a crank shaft (drive shaft) 6 is rotatably supported about its axis L, via a main bearing 7 and a sub-bearing 8. A small-diameter shaft section 6A is provided at one end (left side in FIG. 1) of the crank shaft 6 and passes through the front housing 3 to protrude leftward in FIG. 1. A protruding part of the small-diameter shaft section 6A is provided with an electromagnetic clutch and a pulley (not shown), used to receive power, as conventionally known, and therefore, power is transferred from a drive source, such as an engine, via a V belt. A mechanical seal (lip seal) 9 is provided between the main bearing 7 and the sub-bearing 8 to air-seal the inside of the housing 2 from the atmosphere.

A large-diameter shaft section 6B is provided at the other end (right side in FIG. 1) of the crank shaft 6 and is integrally provided with a crank pin 6C that is eccentric from the axis L of the crank shaft 6 by a predetermined distance. The crank shaft 6 is rotatably supported in the front housing 3 when the large-diameter shaft section 6B and the small-diameter shaft section 6A are supported by the main bearing 7 and the sub-bearing 8, respectively. The crank pin 6C is coupled to an orbiting scroll 15, to be described later, via a drive bush 10, a cylindrical ring (floating bush) 11, and a drive bearing 12, and, when the crank shaft 6 is rotated, the orbiting scroll 15 is driven in an orbiting manner.

A balance weight 10A that eliminates an unbalanced load occurring when the orbiting scroll 15 is driven in an orbiting manner is integrally formed on the drive bush 10 and orbits when the orbiting scroll 15 is driven in an orbiting manner. A crank-pin hole 10B into which the crank pin 6C is inserted is provided for the drive bush 10 at a position eccentric from the center of the drive bush 10. With this structure, the drive bush 10, into which the crank pin 6C is inserted, and the orbiting scroll 15 rotate about the crank pin 6C upon reception of gas pressure, thus forming a known driven crank mechanism in which the orbit radius of the orbiting scroll 15 is variable.

A scroll compression mechanism (compression mechanism) 13 constituted by a pair formed of a fixed scroll 14 and the orbiting scroll 15 is installed in the housing 2. The fixed scroll 14 is formed of an end plate 14A and a spiral wrap 14B provided upright on the end plate 14A, and the orbiting scroll 15 is formed of an end plate 15A and a spiral wrap 15B provided upright on the end plate 15A.

The fixed scroll 14 and the orbiting scroll 15 of this embodiment have step portions at predetermined positions along the spiral direction of tip surfaces and bottom surfaces of the spiral wraps 14B and 15B. With the step portions serving as the boundaries, the wrap tip surfaces are high at the outer circumferential side in the orbiting axial direction and are low at the inner circumferential side. The bottom surfaces are low at the outer circumferential side in the orbiting axial direction and are high at the inner circumferential side. Thus, the height of each of the spiral wraps 14B and 15B is higher at the outer circumferential side than at the inner circumferential side.

The fixed scroll 14 and the orbiting scroll 15 are engaged with each other with their centers being separated from each other by the orbit radius and with the phases of the spiral wraps 14B and 15B being shifted by 180 degrees, and are assembled so as to have, at room temperature, a small clearance (several tens to several hundreds of microns) in the wrap-height direction between the tip surfaces and the bottom surfaces of the spiral wraps 14B and 15B. Thus, as shown in FIG. 1, between the scrolls 14 and 15, a pair of compression chambers 16 enveloped by the end plates 14A and 15A and the spiral wraps 14B and 15B are formed symmetrically with respect to the scroll center; and the orbiting scroll 15 can smoothly orbit around the fixed scroll 14.

With the spiral wraps 14B and 15B being higher at the outer circumferential side in the orbiting axial direction than at the inner circumferential side, the compression chambers 16 constitute the scroll compression mechanism 13 capable of performing three-dimensional compression in which gas can be compressed in the circumferential direction and in the wrap-height direction of the spiral wraps 14B and 15B. On each of the tip surfaces of the spiral wraps 14B and 15B of the fixed scroll 14 and the orbiting scroll 15, a tip seal 17 is fitted into a groove provided on the tip surface so as to seal a tip-seal surface that is formed between the tip surface of its own scroll and the bottom surface of the other scroll.

The fixed scroll 14 is fixed and mounted on the inner surface of the rear housing 4 with bolts 18. The crank pin 6C, provided at one end of the crank shaft 6, is coupled to a boss portion 15C provided on a back surface of the end plate 15A, via the drive bush 10, the cylindrical ring (floating bush) 11, and the drive bearing 12, as described above, and thus, the orbiting scroll 15 is driven in an orbiting manner.

The orbiting scroll 15 is driven so as to orbit around the fixed scroll 14 while the back surface of the end plate 15A is supported on a thrust receiving surface 3B of the front housing 3 and the rotation of the orbiting scroll 15 is prevented by a rotation-preventing mechanism 19 provided between the thrust receiving surface 3B and the back surface of the end plate 15A. The rotation-preventing mechanism 19 of this embodiment is a pin-and-ring-type rotation-preventing mechanism 19 in which a rotation-preventing pin 19B embedded in a pin hole provided in the front housing 3 is slidably inserted into an inner circumferential surface of a rotation-preventing ring 19A embedded in a ring hole provided in the end plate 15A of the orbiting scroll 15.

The fixed scroll 14 has a discharge port 14C for discharging compressed refrigerant gas, at the center of the end plate 14A, and the discharge port 14C is provided with a discharge reed valve 21 attached to the end plate 14A via a retainer 20. A seal member 22, such as an O-ring, is inserted between the back surface of the end plate 14A and the inner surface of the rear housing 4 to bring them into close contact, so as to form therebetween a discharge chamber 23 obtained by partitioning an interior space of the housing 2. Thus, the interior space of the housing 2, except for the discharge chamber 23, serves as a suction chamber 24.

Refrigerant gas returning from a refrigeration cycle is sucked into the suction chamber 24 via a suction port 25 provided in the front housing 3 and is further sucked into the compression chambers 16 through the suction chamber 24. A seal member 26, such as an O-ring, is inserted between joint surfaces of the front housing 3 and the rear housing 4 to air-seal the suction chamber 24 formed in the housing 2 from the atmosphere.

In the above-described scroll compressor 1, the cylindrical ring (floating bush) 11 is rotatably fitted to the outer periphery of the drive bush 10 that drives the orbiting scroll 15 in an orbiting manner, thus avoiding concentrated surface fatigue occurring on the surface of the drive bush 10 and preventing the occurrence of flaking. One end of the cylindrical ring 11 is brought into contact with a step portion provided on the drive bush 10, thus preventing the crank pin 6C from falling out toward the base end. On the other hand, an E-type retaining ring 27 embedded in grooves provided at the tip of the crank pin 6C prevents the crank pin 6C from falling out toward the tip end.

Figure 2:
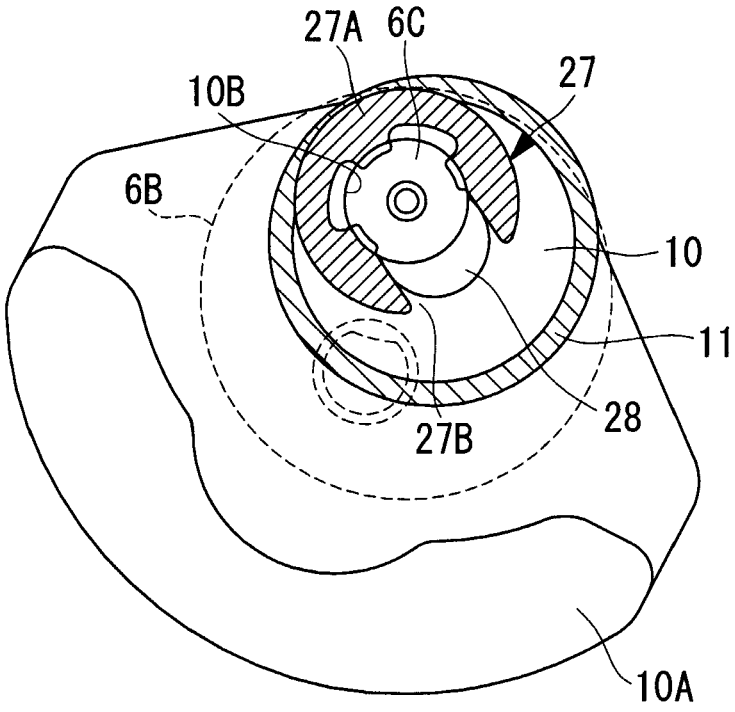
FIG. 2 is a side view of a drive section of an orbiting scroll of the scroll compressor shown in FIG. 1, viewed from a crank pin side.

As shown in FIG. 2, in the E-type retaining ring 27, which is universal, an opening portion 27B is provided at part of a ring part 27A in order for the E-type retaining ring 27 to fit into the shaft portion, and the outer shape thereof is substantially restricted in accordance with the inner diameter thereof. The E-type retaining ring 27 is mounted on the tip of the crank pin 6C inserted into the crank-pin hole 10B, which is provided at a position eccentric from the center of the drive bush 10, and is installed such that part of the ring part 27A is directly engaged with the cylindrical ring 11. On the other hand, the cylindrical ring 11 is concentrically fitted to the outer periphery of the drive bush 10.

Thus, even if the E-type retaining ring 27 is installed such that part of the ring part 27A is engaged with the cylindrical ring 11 in the initial mounting state, when the E-type retaining ring 27 is rotated and the opening portion 27B thereof is moved to a position where the part of the ring part 27A is engaged with the cylindrical ring 11, the engagement allowance (area) of the E-type retaining ring 27 with respect to the cylindrical ring 11 is reduced. Therefore, in this embodiment, in the initial mounting state where the E-type retaining ring 27 is set to have, on the shaft-end-side end surface of the drive bush 10, a predetermined engagement allowance with respect to the cylindrical ring 11, a rotation-preventing protrusion 28 that interferes with the opening portion 27B to inhibit the rotation of the E-type retaining ring 27 is provided at a position corresponding to the opening portion 27B provided for the E-type retaining ring 27.

With the structure described above, according to this embodiment, the following effects are afforded.

When a rotary drive force is transferred from an external drive source to the crank shaft 6 via the pulley and the electromagnetic clutch, which are not shown, and the crank shaft 6 is rotated, the orbiting scroll 15 coupled to the crank pin 6C via the drive bush 10, the cylindrical ring (floating bush) 11, and the drive bearing 12 such that the orbit radius is variable is driven so as to orbit around the fixed scroll 14 with a predetermined orbit radius, while the orbiting scroll is prevented from rotating by the pin-and-ring-type rotation-preventing mechanism 19.

Through the driving of the orbiting scroll 15 in an orbiting manner, refrigerant gas in the suction chamber 24 is sucked into the compression chambers 16 formed outermost in the radius direction. After suction of refrigerant gas is stopped at a predetermined orbiting-angle position, the compression chambers 16 are moved toward the center while reducing the volumes in the circumferential direction and in the wrap-height direction. The refrigerant gas is compressed during that time and pushes the discharge reed valve 21 open when the compression chambers 16 reach positions where they communicate with the discharge port 14C. As a result, the compressed high-temperature high-pressure gas is discharged to the discharge chamber 23 and is sent outside the compressor 1 through the discharge chamber 23.

During the above-described compression operation, the cylindrical ring (floating bush) 11 is rotated relative to the outer periphery of the drive bush 10. Thus, even if a load imposed on the drive bush 10 from the orbiting scroll 15 via the drive bearing 12 always concentrates at the same position, an effect equivalent to that obtained when the surface of the drive bush 10 is moved can be obtained. Therefore, it is possible to avoid concentrated surface fatigue occurring on the surface of the drive bush 10, to prevent the occurrence of flaking, and to extend the lifetime of the drive bush 10.

The cylindrical ring (floating bush) 11 is prevented from falling out toward the tip end of the crank pin 6C by the E-type retaining ring 27 mounted on the tip of the crank pin 6C. Furthermore, since the rotation-preventing protrusion 28, which interferes with the E-type retaining ring 27 to inhibit the rotation of the E-type retaining ring 27, is provided on the end surface of the drive bush 10, the rotation-preventing protrusion 28 can reliably prevent the E-type retaining ring 27, which inhibits the axial movement of the cylindrical ring 11, from rotating about the crank pin 6C.

Thus, it is possible to hold the E-type retaining ring 27 at the initial mounting position where the ring part 27A is set to have the predetermined engagement allowance with respect to the cylindrical ring 11 and to prevent a situation in which the engagement allowance (area) of the E-type retaining ring 27 with respect to the cylindrical ring 11 is reduced when the opening portion 27B is moved to a position where the ring part 27A is engaged with the cylindrical ring 11, through the rotation and vibration of the cylindrical ring 11 and the drive bush 10. As a result, it is possible to prevent abnormal wear generated by an increase in surface pressure of the E-type retaining ring 27 caused by a reduction in the engagement allowance with respect to the cylindrical ring 11 and to avoid problems due to deterioration in function.

In this embodiment, the rotation-preventing protrusion 28 is provided at a position where it interferes with the opening portion 27B of the E-type retaining ring 27, in the initial mounting state where the E-type retaining ring 27 is set to have a predetermined engagement allowance (area) with respect to the cylindrical ring 11; therefore, the E-type retaining ring 27 is prevented from rotating by the rotation-preventing protrusion 28, provided at the position where it interferes with the opening portion 27B, even if the E-type retaining ring 27 attempts to rotate leftward or rightward from the initial mounting position in accordance with the rotation and vibration of the cylindrical ring 11 and the drive bush 10. Therefore, it is possible to maintain the predetermined engagement allowance of the E-type retaining ring 27 with respect to the cylindrical ring 11 and to reliably avoid problems, such as abnormal wear of the E-type retaining ring 27 caused by a reduction in the engagement allowance.

Second Embodiment

Next, a second embodiment of the present invention will be described using FIGS. 3A to 3C.

In this embodiment, the structures of a retaining ring and a rotation-preventing protrusion differ from those described above in the first embodiment. Since the other points are the same as those in the first embodiment, a description thereof will be omitted.

Figure 3A:
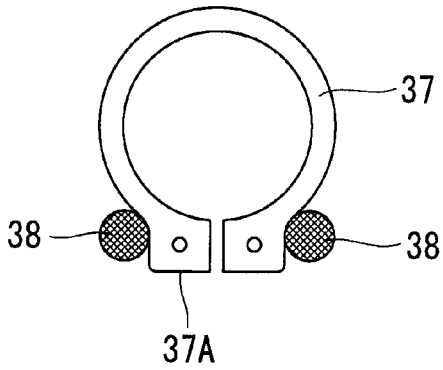
FIG. 3A is a side view of a modification of a retaining ring for preventing the movement of a cylindrical ring, and a rotation inhibitor of the retaining ring, in a scroll compressor according to a second embodiment of the present invention.
Figure 3B:
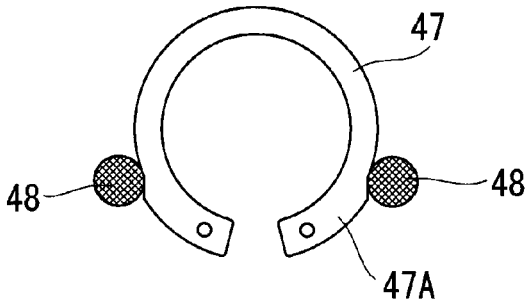
FIG. 3B is a side view of a modification of the retaining ring for preventing the movement of the cylindrical ring, and the rotation inhibitor of the retaining ring, in the scroll compressor according to the second embodiment of the present invention.
Figure 3C:
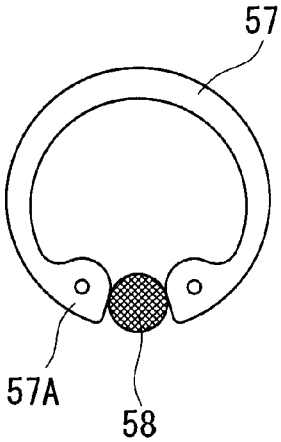
FIG. 3C is a side view of a modification of the retaining ring for preventing the movement of the cylindrical ring, and the rotation inhibitor of the retaining ring, in the scroll compressor according to the second embodiment of the present invention.

In this embodiment, as the retaining ring that prevents the cylindrical ring (floating bush) 11 from falling out toward the shaft end, a C-type retaining ring 37, an R-type retaining ring 47, and an S-type retaining ring 57 are used, as shown in FIGS. 3A to 3C, instead of the above-described E-type retaining ring 27.

What are used as rotation-preventing protrusions of the retaining rings 37, 47, and 57 around the crank pin 6C are structures in which a pair of circular protrusions 38 and a pair of circular protrusions 48 are provided at positions where they interfere with the outer peripheries of a pair of engaging portions 37A and a pair of engaging portions 47A provided for the retaining rings 37 and 47, respectively, in an initial mounting state where the retaining rings 37 and 47 have, on the end surface of the drive bush 10, predetermined engagement allowances with respect to the cylindrical ring 11, as shown in FIGS. 3A and 3B, and a structure in which a circular protrusion 58 is provided between a pair of engaging portions 57A provided for the retaining ring 57 so as to interfere with the engaging portions 57A, as shown in FIG. 3C.

With the above-described structures, when the retaining rings 37, 47, and 57 attempt to rotate leftward or rightward from the initial mounting position in accordance with the rotation and vibration of the cylindrical ring 11 and the drive bush 10, it is possible to prevent the rotation of the retaining rings 37, 47, and 57 through interference with the pair of rotation-preventing protrusions 38 and the pair of rotation-preventing protrusions 48, which are provided at positions where they interfere with the outer peripheries of the pair of engaging portions 37A and the pair of engaging portions 47A, respectively, or through interference with the rotation-preventing protrusion 58, provided between the pair of engaging portions 57A. Thus, as in the above-described first embodiment, it is possible to maintain the predetermined engagement allowances (areas) of the retaining rings 37, 47, and 57 with respect to the cylindrical ring 11 and to prevent abnormal wear caused by a reduction in the engagement allowance, thus avoiding problems due to deterioration in function.

Third Embodiment

Next, a third embodiment of the present invention will be described using FIG. 4.

In this embodiment, compared with the above-described first embodiment, a special method is used to form a rotation-preventing protrusion 68. Since the other points are the same as those in the first embodiment, a description thereof will be omitted.

Figure 4:
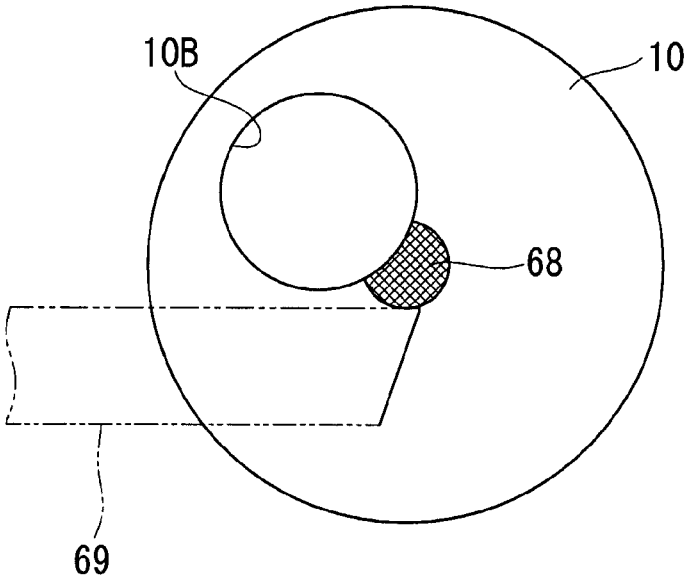
FIG. 4 is a view showing processing of a rotation inhibitor that inhibits the rotation of a retaining ring of a scroll compressor according to a third embodiment of the present invention.

In this embodiment, as shown in FIG. 4, when the end surface of the drive bush 10 is cut with a cutting tool 69, the cutting tool 69 is moved forward so as not to pass the center of the drive bush 10 to leave an outward protrusion at the center of the drive bush 10, thereby forming the rotation-preventing protrusion 68 of the retaining ring (E-type retaining ring 27) provided on the end surface of the drive bush 10. Note that a portion of the protrusion 68 that overlaps with the crank-pin hole 10B is cut when the crank-pin hole 10B is processed.

As described above, since the rotation-preventing protrusion 68 of the E-type retaining ring 27 is an outward protrusion left at the center of the end surface of the drive bush 10 when the end surface is cut, the protrusion 68, which serves to prevent the rotation of the E-type retaining ring 27, can be formed at the same time as the end surface of the drive bush 10 is cut. Therefore, it is possible to provide the rotation-preventing protrusion 68 without increasing processing man-hours or using an additional part, to prevent abnormal wear of the E-type retaining ring 27 without unnecessary cost or man-hours, and to avoid problems due to deterioration in function.

The present invention is not limited to the above-described embodiments and can be appropriately modified without departing from the scope thereof. For example, in the above-described embodiments, the rotation-preventing protrusions 28, 38, 48, and 58 have a crescent shape or a circular shape; however, the shape thereof is not limited thereto, and they may have another shape, such as a square shape. These protrusions may be provided when a pin or the like is embedded in the end surface of the drive bush 10.

The retaining rings 27, 37, 47, and 57 are not limited to the above-described E-type, C-type, R-type, and S-type, and it is needless to say that another equivalent retaining ring can be used.

REFERENCE SIGNS LIST

1 scroll compressor
6 crank shaft
6C crank pin
10 drive bush
11 cylindrical ring (floating bush)
12 drive bearing
15 orbiting scroll
27 E-type retaining ring
27B opening portion
28, 38, 48, 58, 68 rotation-preventing protrusion
37 C-type retaining ring
37A, 47A, 57A engaging portion
47 R-type retaining ring
57 S-type retaining ring
69 cutting tool

The invention claimed is:

1. A scroll compressor comprising:

a crank shaft that has a crank pin at a shaft end;

a drive bush into which the crank pin is fitted;

a cylindrical ring that is rotatably fitted to an outer periphery of the drive bush and whose axial movement is inhibited by a retaining ring configured to be a c-shape having an opening portion at a part thereof mounted on the tip of the crank pin; and a drive bearing that is fitted to an outer periphery of the cylindrical ring, an orbiting scroll fitted to an outer periphery of the drive bearing being driven in an orbiting manner through rotation of the crank shaft, wherein a rotation inhibitor that interferes with the retaining ring to inhibit rotation of the retaining ring is provided on an end surface of the drive bush.

2. A scroll compressor according to claim 1, wherein the rotation inhibitor is formed of a protrusion that protrudes axially outward from the end surface of the drive bush.

3. A scroll compressor according to claim 1, wherein the rotation inhibitor is provided at a position where it interferes with an opening portion provided for the retaining ring, in an initial mounting state where the retaining ring is set to have a predetermined engagement allowance with respect to the cylindrical ring.

4. A scroll compressor according to claim 1, wherein a pair of the rotation inhibitors are provided at positions where they interfere with outer peripheries of a pair of engaging portions provided for the retaining ring, in an initial mounting state where the retaining ring is set to have a predetermined engagement allowance with respect to the cylindrical ring.

5. A scroll compressor according to claim 1, wherein the rotation inhibitor is formed of an outward protrusion left at the center of the end surface of the drive bush when the end surface is cut.

* * * * *